United States Patent [19]

Pendergrass, Jr.

[11] Patent Number: 4,935,401

[45] Date of Patent: Jun. 19, 1990

[54] REVEALED IMAGE SYSTEM

[75] Inventor: Daniel B. Pendergrass, Jr., St. Paul, Minn.

[73] Assignee: Minnesota Mining and Manufacturing Company, St. Paul, Minn.

[21] Appl. No.: 24,355

[22] Filed: Mar. 10, 1987

[51] Int. Cl.[5] ..... B41M 5/16

[52] U.S. Cl. ..... 503/206; 503/200; 503/215; 503/226

[58] Field of Search ..... 503/206, 226, 200, 215

[56] References Cited

U.S. PATENT DOCUMENTS

| | | | |
|---|---|---|---|
| 3,503,783 | 3/1970 | Evans | 117/47 |
| 4,036,511 | 7/1977 | Maalouf | 503/226 |
| 4,360,548 | 11/1982 | Skees et al. | 503/206 |
| 4,533,567 | 8/1985 | Marinelli | 503/226 |
| 4,642,662 | 2/1987 | Torii et al. | 503/226 |

*Primary Examiner*—Bruce H. Hess

*Attorney, Agent, or Firm*—Donald M. Sell; Walter N. Kirn; Mark A. Litman

[57] ABSTRACT

A sheet is provided which upon abrasion of one surface will reveal a preprinted message without removal of a cover layer.

14 Claims, No Drawings

REVEALED IMAGE SYSTEM

BACKGROUND OF THE INVENTION

It is often desirable to have preprinted messages which can be revealed upon a predetermined stimulation such as pressure or abrasion. Typical uses are in game and lottery tickets where opaque, highly pigmented coatings are applied over printed messages. The opaque coatings are scraped off to reveal the message below. These systems tend to be quite messy, the abraded coating leaving particles and flakes that fall off the sheet.

U.S. Pat. No. 4,111,462 discloses an imaging system which comprises a coating of a colorless reactant which is dispersed in a binder with rupturable microcapsules. The microcapsules contain a second reactant which when contacted with the colorless reactant forms a visible color. By abrading the coating in an imagewise fashion, the microcapsules are broken, the reactants contact each other, and an image is formed.

Encapsulated materials have been used for many years in a wide variety of commercial applications. Early uses of encapsulated materials included paper coated with capsules bearing coloring material therein which could be used as a recording medium. U.S. Pat. No. 3,016,308 discloses one of the early efforts using encapsulated material as the image source on recording paper. U.S. Pat. Nos. 4,058,434 and 4,201,404 show other methods of application of encapsulated coloring materials on paper substrates to be used as imaging media and the like. U.S. Pat. No. 3,503,783 shows microcapsules having coloring material therein which are rupturable by the application of heat, pressure and/or radiation. The color is formed because of a metal coating on the surface of the capsule. These rupturable microcapsules, in one embodiment, may be secured between a substrate and a photoconductive top coat to enable photosensitive imaging of the system.

U.S. patent application Ser. No. 899,424 filed Aug. 22, 1986 in the name of Keith E. Relyea discloses a substrate that has a discontinuous coating of a material capable of reacting to form a color or be bleached to a colorless state. A coating of a binder with microcapsules is coated over the discontinuous coating. The microcapsules contain a reactant which will cause the color change in the discontinuous coating. Abrasion, pressure, or removal of a layer adhered to the binder layer releases the reactant to cause the color change in the discontinuous coating.

SUMMARY OF THE INVENTION

A system is provided for the generation of images upon abrasion or pressure. The system comprises a porous carrier sheet having two faces. One face has a chemically latent image thereon and the other face has an activating chemistry in microcapsules adhered thereto. Upon rupture of the microcapsules, the activating chemistry passes through the porous carrier sheet and generates a visible image from the latent image.

DETAILED DESCRIPTION OF THE INVENTION

An abrasion or pressure imageable system is provided which comprises a porous substrate having an imagewise distributed coating on at least one surface. The coating comprises a colorizable or decolorizable material. On the other surface of the porous substrate is a binder layer containing frangible microcapsules. The microcapsules contain a substance which will react with the color active material to create, change, or remove color. Over the imagewise distributed coating may be a transparent or a translucent cover sheet, through which the image formation or change can be seen. A cover layer or sheet may also be used over the microcapsule layer. This may be opaque or transparent.

The surface of substrate on which a color-active ingredient is placed can be substantially any porous material through which the imaging chemistry can pass. Paper and polymeric porous surfaces as well as metallic or ceramic porous surfaces are particularly useful. Thin foam sheets (reticulated foam) and fused fiber sheets are particularly useful.

The color-active ingredient may be applied to the substrate in a wide variety of fashions. The ingredient may be dispersed or dissolved in the substrate if the substrate can be penetrated or otherwise reactively associated with the encapsulated second active ingredient. It may be coated on the surface of the substrate as a pure layer or dispersed/dissolved in a carrying medium such as a polymeric binder. The color-active ingredient may be applied by printing, painting, diffusion transfer, sublimation or any other convenient manner.

Imageable materials can also be made by printing one surface of a sheet with an invisible latent image, applying the capsules with delatentizing chemistry over the other surface of the sheet in a binder, and further using the binder to secure a second layer to that surface. This can be readily done according to techniques described in U.S. Pat. No. 4,487,801. This tends to be an inefficient use of chemistry, however, since about half of the imaging chemistry would be removed upon separation of the second layer, the image being formed by separation of the layers which ruptures the microcapsules and causes cohesive failure of the binder.

Typically useful color-active ingredients include colorless leuco dyes, leuco dyes, dye forming reagents, bleachable dyes, metal salts, and the like. The particular material must be selected in combination with the active ingredient in the microcapsules. The two materials must be chosen to react together. For example, leuco dyes should be used with oxidizing agents, one dye-forming reagent must be used with its counterpart reagent, metal salts may be used with organic acids or bases, etc. The color-active chemistry used in the practice of the present invention may be selected from a wide source of imaging materials available in the art. Examples of available combinations of imaging materials which can be separated and then mixed to form a reaction according to the present invention are impact capsule compositions and carbonless paper compositions (e.g., U.S. Pat. Nos. 4,111,462; 3,576,660; 3,020,171), pH indicators (e.g., phenolphthalein and a base), bleachable dyes and oxidizing agents (U.S. Pat. No. 4,370,020), and leuco dyes and oxidizing agents (e.g., U.S. Pat. No. 4,379,835). Additional materials are shown in U.S. Pat. Nos. 3,632,364; 3,451,143; 3,784,394; 3,725,104; 3,682,673; 3,617,324; 3,540,909; 3,540,914 and 3,850,649.

A preferred composition comprises a color-generating component and a color-activating component. As used herein, the term "color-generating component" refers to any of the materials known in the carbonless paper art which will themselves become colored or effect the visible coloring of a separate material when contacted with a material that will cause a color change in the color-generating component (i.e., a color-activating component). Thus, the combination of materials is essential for color formation. For purpose of convenience herein the components in the latent, sensitizing ink will be referred to as the color-generating component, while the component which is subsequently used to develop the color will be called the color-activating component, although the actual components can be interchanged as will be described hereinafter. The advantageous properties of the inks of this invention are realized through the use of the aforementioned non-polymeric vehicle component. Surprisingly, the vehicle components described herein act as a vehicle for the ink components, including the color-generating components, without inhibiting color development as do the conventional polymeric, film-forming vehicles or binders.

The latent, sensitizing inks comprise, based on the weight of the total ink composition, about 5 to 55% by weight vehicle component which is a non-polymeric, oleophilic, organic, Arrhenius acid anion having a cationic counter ion, up to about 30% by weight thinner and up to about 70% by weight oil-receptive, particulate filler. The ink also includes as one of the above components, or as an additional component, at least about 5% by weight of at least one color-generating component. The ratio of filler to the vehicle component is from about 0.5:1 to 6:1. Other ingredients such as additional tack and viscosity modifiers, antioxidants, wetting agents, optical brighteners and the like can be added as necessary.

The term "Arrhenius acid" is an art-recognized definition which refers to the class of proton donor compounds which donate protons to water molecules in water solution. See Hilt & Sisler et al., "General Chemistry," The Macmillan Co., New York (1949) pp. 325–327, 329, 330. See further Moeller, "Inorganic Chemistry," John Wiley & Sons, New York (1952) p. 308.

The vehicle components described above are preferably the aliphatic, aromatic and alicyclic carboxylic and sulfonic acids containing at least 6 carbon atoms and the cation containing salts of these acids. The vehicle components have sufficiently oleophilic moieties to provide acceptable inking qualities and promote rapid and intense development of the sensitized areas when used in the formulations of this invention. They are particularly effective with the metal complexing color-generating-/color-activating components such as the metal/dithiooxamide (DTO)/polyhydric phenol combinations which require a cosolvent reaction medium for rapid, intense development of the sensitized area. Exemplary of these vehicle components are the rosin, stearic, oleic, 2-ethylhexoic, 2-phenylbutyric, benzoic, hydrocinnamic acids and dinonylnaphthalene sulfonic acids as well as the corresponding cation salts of these acids.

The described vehicle components are generally oily liquids or crystalline or amorphous waxy solids and when dispersed or dissolved in a thinner exhibit the desirable binding and viscosity modifying characteristics of conventional polymeric binders with respect to tack, adhesion, and hydrophobicity which are essential to the suitability of the inks for application by conventional printing methods.

As noted above the color-generating component can be one of the recited ink components or can be an additional distinct component. For example, the color-generating component can be the recited vehicle component or the filler or both. Alternatively the ink can include a separate transition metal salt as an additional, distinct color-generating component.

In one embodiment, the vehicle component is a color-generating vehicle component which is an oleophilic organic Arrhenius acid anion containing at least 6 carbon atoms and having a transition metal counter-ion. The transition metal counter-ion forms a colored complex when contacted with a color-activating metal complexing agent, such as dithiooxamide (DTO) and its derivatives and the polyhydric phenols.

The oleophilic anion moiety aids in providing good inking qualities and in promoting the subsequent development of the latent, sensitized ink.

The transition metal counter ion of these color-generating vehicle components is preferably selected from among nickel, copper, iron and cobalt. Generally nickel and iron are preferred because of the dark color these metals produce with conventional color-activating coreactants such as DTO and its derivatives or the polyhydric phenols. Representative color-generating vehicle components which can be used in the present invention are the nickel, iron, and copper derivatives of aliphatic, aromatic and alicyclic carboxylic and sulfonic acids containing at least 6 carbon atoms and combinations thereof. Thus, nickel rosinate, nickel 2-ethylhexoate, nickel stearate, nickel 2-phenylbutyrate, nickel oleate, nickel benzoate, nickel hydrocinnamate, nickel dinonylnaphthalene sulfonate, as well as the corresponding copper and iron salts of the above compounds, and mixtures of two or more of the above compounds are useful.

An essential ingredient of the latent, sensitizing inks of the present invention is an oil-receptive, particulate filler which can be dispersed in the liquid ink vehicle. These fillers are necessary to maintain the sensitized area suitably receptive to the color-activating material used to develop the latent ink. These fillers can be any of the conventional pigments and extenders which are known in the printing art. The oil-receptive fillers can be chosen so as to be nearly transparent when dispersed in the ink vehicle or can be colored if desired. Thus, when applied to a substrate, the latent, undeveloped ink can be transparent so as to be invisible or can have a color which closely matches or which contrasts with the substrate to which the ink is applied, depending upon the end use of the sensitized substrates.

Representative fillers which can be used are fumed alumina, alumina hydrate, and trihydrate, powdered and fumed silica, calcium and magnesium carbonate, barium sulfate, kaolin clay, attapulgite clay, bentonite clay, zeolites, zinc oxide, urea-formaldehyde pigment, and the like.

The filler can comprise up to about 70% by weight of the ink composition. The larger amounts of filler may be necessary on non-absorptive, smooth papers, whereas lower amounts of the oil-receptive fillers can be used where the paper readily absorbs the ink or has a rough surface which aids in keeping the inked surface receptive to the coreactant. For most applications, the filler preferably comprises about 40 to about 60 percent by weight of the ink composition.

Within the range of compositions disclosed above, it has been found that the ratio of oil-receptive filler to the aforementioned vehicle component is important. In order to obtain the desired printing characteristics along with superior imaging speed and image intensity when the sensitized areas are contacted with a color-activating component, the ratio of filler to vehicle component should be from about 0.5:1 to about 6:1 and preferably about 1.3:1 to about 4:1. When filler amounts below the 0.5:1 ratio are used, the sensitized areas develop with less speed and intensity. The higher ratios are preferred, but ratios above about 6:1 are generally not satisfactory for use on conventional printing presses.

A wide variety of processes exist by which microcapsules can be manufactured. These varied processes provide different techniques for producing capsules of varying sized, alternative materials for the composition of the capsule shell and various different functional materials within the shell. Some of these various processes are shown in U.S. Pat. Nos. 3,516,846; 3,516,941; 3,778,383; 4,087,376; 4,089,802; 4,100,103 and 4,251,386 and British Patent Specification Nos. 1,156,725; 2,041,319 and 2,048,206. A wide variety of different materials may also be used in making the capsule shells. A popular material for shell formation is the polymerization reaction product between urea and formaldehyde or melamine and formaldehyde, or the polycondensation products of monomeric or low molecular weight polymers of dimethylolurea or methylolated urea with aldehydes. A variety of capsule forming materials are disclosed, for example, in U.S. Pat. Nos. 3,516,846 and 4,087,376 and British Patent Specification Nos. 2,006,709 and 2,062,570.

Generally the capsules should have an average diameter between 4 and 150 microns and preferably between 15 and 100 microns when the capsule payload is between 80 and 90% by weight of the total capsule weight. With lower payloads (e.g., 70–80%), the capsules should be large to provide the necessary frangibility. The broadest range of capsule size under any conditions would be about 3 to 400 microns.

The color-active agent may be first applied to the substrate in imagewise fashion over less than the entire surface and then a transparent, translucent, or opaque coating of the capsules in a binder is applied on the other side of the porous sheet. Upon general rupturing of the capsules, the image will appear or change only in the area where the color-active agent is present. The process is most easily practiced when the color active agent is colorless, but striking effects can be accomplished when a different color is produced on a color background. This can be accomplished in a number of manners. If the color-active ingredient is colored, the substrate can be first colored to match that color. The image will then appear as a change in color. Separate printing operations may be used wherein the background of the image is printed the color of the color-active agent, and then that agent is applied to the uncolored areas. The image will not readily appear until the color changing operation has occurred. These and other aspects of the invention will be shown in the following, non-limiting example. The porous layer may even be formed by coating a porous material over a layer comprising one of the active image forming layers of the present invention.

EXAMPLE

Formulation

The following mixture was coated on 40 lb. uncoated paper base.

| Mixture A | |
|---|---|
| Wet cake capsules (as shown in Example 1 of U.S. Pat. 4,111,462) as 40.5% solids in water | 74.1 gms |
| Gelvatol 40-10, polyvinyl alcohol (39% in $H_2O$ solution) | 8.97 gms |
| Wet cake capsules similar to those described above, but containing cherry fragrance oil instead of the color-activating material as 34.91% solids in water | 7.16 gms |
| Mixture B | |
| A latent ink substantially the same as that shown in GB 2,043,671B, Example 3, except having glacial acetic acid in place of the o-chlorobenzoic acid was added to 500 gms of water and ball-milled for 24 hours at room temperature | 17 gms |

Mixture A was coated uniformly across one surface of the paper. Mixture B was then imagewise coated on the other side of the paper and the paper was then dried. Once dry, the construction forms a color image upon abrasion of the capsules and penetration of the chemistry of the capsules through the porous substrate.

By printing the latent ink onto an imagewise distributed portion of the paper and not mixing it with Mixture A, rupture of the capsules caused an image to form only in the areas where the latent ink was coated.

What is claimed is:

1. An article having an abrasion generable image on at least one surface thereof said article comprising (1) a substrate consisting essentially of a porous substrate having (2) an imagewise distributed material on at least one surface thereof which is capable of undergoing a visible color change upon reactive contact with a chemical composition and (3) on the other side of said porous substrate a binder layer containing microcapsules, said microcapsules carrying a chemical composition capable of passing through said porous substrate and interacting with said imagewise distributed material to cause a visible color change.

2. The article of claim 1 wherein said substrate is porous polymeric film or paper.

3. The article of claim 2 wherein said chemical composition in said microcapsules is a liquid.

4. The article of claim 3 wherein said imagewise distributed material comprises based on the weight of the total ink composition, about 5 to 55% by weight of a vehicle component which is a non-polymeric, oleophilic, organic, proton donor acid anion having a cationic counter-ion, up to about 70% by weight oil-receptive, particulate filler and up to about 30% by weight thinner and wherein said ink includes at least 5% by weight of at least one color-generating component, the ratio of said filler to said vehicle component being from about 0.5:1 to 6:1.

5. The article of claim 2 wherein said imagewise distributed material comprises based on the weight of the total ink composition, about 5 to 55% by weight of a vehicle component which is a non-polymeric, oleophilic, organic, proton donor acid anion having a cationic counter-ion, up to about 70% by weight oil-receptive, particulate filler and up to about 30% by weight thinner and wherein said ink includes at least 5% by weight of at least one color-generating component, the ratio of said filler to said vehicle component being from about 0.5:1 to 6:1.

6. The article of claim 1 wherein said chemical composition in said microcapsules is a liquid.

7. The article of claim 6 wherein said imagewise distributed material comprises based on the weight of the total ink composition, about 5 to 55% by weight of a vehicle component which is a non-polymeric, oleophilic, organic, proton donor acid anion having a cationic counter-ion, up to about 70% by weight oil-receptive, particulate filler and up to about 30% by weight thinner and wherein said ink includes at least 5% by weight of at least one color-generating component, the ratio of said filler to said vehicle component being from about 0.5:1 to 6:1.

8. The article of claim 6 wherein said porous substrate comprises a thin foam sheet.

9. The article of claim 6 wherein said porous substrate is a fused fiber sheet.

10. The article of claim 1 wherein said imagewise distributed material comprises based on the weight of the total ink composition, about 5 to 55% by weight of a vehicle component which is a non-polymeric, oleophilic, organic, proton donor acid anion having a cationic counter-ion, up to about 70% by weight oil-receptive, particulate filler and up to about 30% by weight thinner and wherein said ink includes at least 5% by weight of at least one color-generating component, the ratio of said filler to said vehicle component being from about 0.5:1 to 6:1.

11. The article of claim 10 wherein said porous substrate comprises a thin foam sheet.

12. The article of claim 10 wherein said porous substrate is a fused fiber sheet.

13. The article of claim 1 wherein said porous substrate comprises a thin foam sheet.

14. The article of claim 1 wherein said porous substrate is a fused fiber sheet.

* * * * *